US007407425B2

(12) United States Patent
Jeske

(10) Patent No.: US 7,407,425 B2
(45) Date of Patent: Aug. 5, 2008

(54) WALLED STRUCTURE APPARATUS

(75) Inventor: Stewart P. Jeske, 11000 N. Grand Ave., Kansas City, MO (US) 64155

(73) Assignee: Stewart P. Jeske, Kansas City, MO (US)

( * ) Notice: Subject to any disclaimer, the term of this patent is extended or adjusted under 35 U.S.C. 154(b) by 37 days.

(21) Appl. No.: 11/454,036

(22) Filed: Jun. 15, 2006

(65) Prior Publication Data

US 2007/0004312 A1 Jan. 4, 2007

Related U.S. Application Data

(63) Continuation-in-part of application No. 10/856,159, filed on May 29, 2004, now abandoned.

(51) Int. Cl.
*A63H 33/08* (2006.01)
*A63H 33/00* (2006.01)

(52) U.S. Cl. ..... 446/108; 446/114; 446/478; 446/901

(58) Field of Classification Search ..... 446/476, 446/478, 108, 114, 115, 488, 901; 273/160, 273/153 R See application file for complete search history.

(56) References Cited

U.S. PATENT DOCUMENTS

| | | | | | |
|---|---|---|---|---|---|
| 2,558,591 | A | * | 6/1951 | Starck | 446/115 |
| 3,546,792 | A | * | 12/1970 | Sherman | 434/96 |
| 3,603,004 | A | * | 9/1971 | Fink | 434/73 |
| 5,215,490 | A | * | 6/1993 | Szoradi | 446/115 |
| 5,330,379 | A | * | 7/1994 | Roh et al. | 446/71 |
| 5,707,269 | A | * | 1/1998 | Murphy | 446/268 |
| 5,823,533 | A | * | 10/1998 | Edwards | 273/160 |
| 5,895,045 | A | * | 4/1999 | Vilar | 273/160 |

* cited by examiner

*Primary Examiner*—Kien T Nguyen
(74) *Attorney, Agent, or Firm*—Intellectual Property Center, LLC; Arthur K. Shaffer

(57) ABSTRACT

A walled structure apparatus generally orientated perpendicular to a horizontal surface, the apparatus including a first panel with a major plane, a corner and a notch, a second panel with a major plane, a corner and a tab received with the notch, and a hinge structure within the notch.

The hinge structure generally uniting the panels for movement to a number of selected positions and includes interengaged flexible components permitting inward and outward movement and being generally located within the notch and tab. Through this movement, the walled structure apparatus exhibits a deformed structure.

14 Claims, 8 Drawing Sheets

WALLED STRUCTURE APPARATUS

CROSS REFERENCE TO RELATED APPLICATION

This application is a continuation-in-part of the prior filed, non-provisional U.S. patent application Ser. No. 10/856,159, filed May 29, 2004 now abandoned which is incorporated herein by reference.

FIELD OF THE INVENTION

The present invention relates generally to structures and more particularly to a walled structure for a demonstrating deformed orientations adapted for use with toys.

BACKGROUND OF THE INVENTION

Children enjoy activities of assembling and dismantling three-dimensional objects. Popular toys have included numerous constructions sets with attachable pieces. Some construction sets include very small pieces making assembly of walls and simulated buildings time consuming sometimes beyond the attention span of some children. Smaller pieces that may be fit into mouths allowing a child to choke are also considered hazardous for small children. In addition, some construction sets when assembled produce very rigid structures, which inhibit observation of the collapse and partial collapse of the construction. Children particularly enjoy observing the reverse of construction.

Inventors have designed many types of interconnectable toy wall panels utilizing hook and loop type fasteners. U.S. Pat. No. 5,707,269 to Murphy (1998) discloses a set of six planar wall panels utilizing hook and loop type fasteners attached to all four corners of each panel, such that the panels may be assembled into a cube. However, the construction disclosed does not resemble toy buildings and securely fastens corner edges with 3-degrees of rotational fixity which disallows collapsible rotation about the panel top edges.

U.S. Pat. No. 4,978,301 to Dodge (1990) discloses a set of planar construction pieces with opposing surfaces covered with hook and loop type fastening material and connector strips of hook and loop type material. The disclosed construction may be cost prohibitive and appears to impose a limitation on rotation about the connection points, prohibiting the simulation of a collapsible structure.

U.S. Pat. No. 5,964,634 to Chang (1999) discloses a kit for building objects of foam blocks covered with loop type fabric with double sided hook type fastening pieces for interconnecting blocks. The double-sided hook type fasteners allow two pieces to be adjacently connected with the double-sided hook fasteners between; however, the construction imposes limitations in rotation of the pieces of the structure.

U.S. Pat. No. 4,884,998 to McMurray (1989) discloses a building play toy kit having panels with curved edge strips attached. Each edge strip may include alternating overlays of hook and loop type fastening material along the full edge of the strip effectively creating hinged edges. U.S. Pat. No. 4,055,019 to Harvey (1977) discloses a building toy kit containing planar elements having detachable edges. In addition, U.S. Pat. No. 4,635,411 to Kurzea (1987) discloses another similar construction, utilizing planar panels that are also connected at the edges by hinge type connections.

The construction identified by these patents imposes limitations on rotation about panel edges and they do not provide for panel interconnections in such a way as to allow resistive rotation about the connection point to simulate collapse through resistive joint rotation. In addition, the construction previously described by the above patents does not allow the interconnected panel edges to move independently with reference to each other, inhibiting the deformation of the structures.

It would therefore be beneficial to provide interconnected panels with a top panel connection which allows resistive rotation about the connection point, the structure exhibiting deformation with the interconnected panels providing independent movement with reference to each other.

SUMMARY OF THE INVENTION

The present invention provides a walled structure apparatus orientated perpendicularly to a horizontal surface including a first panel with a major plane, a corner and a notch, a second panel with a major plane, a corner and a tab received with the notch, and a hinge structure within the notch. In an alternative embodiment, the apparatus may include a third panel with a major plane, a first corner with a notch adapted to receive the projecting tab of the first panel and a second corner presenting a tab received within a second corner notch of the second panel. In yet another alternative embodiment, the apparatus may include a fourth-panel with a major plane, a first corner with a notch adapted to receive the projecting tab of the third panel and a second corner presenting a projecting tab for receipt within the notch of the second-panel, wherein said second-panel is generally parallel to the third-panel and the forth panel is generally parallel to the first-panel.

The hinge structure unites the panels for movement to a number of selected positions and includes interengaged flexible components permitting inward and outward movement and being generally located within the notch and tab. Through this movement, the walled structure apparatus exhibits a deformed structure. In another embodiment, the apparatus may include a central axis parallel to the panels and extending through the horizontal surface wherein the first and second panels rotate about the central axis for exhibiting the deformed structure. In yet another embodiment, the apparatus may further include a panel opening, an internal area located between the panels and the central axis, and a complementary outer area located between the panels and opposite the internal area, where the internal area is in communication with the outer area at the panel openings. Optionally, the apparatus may include a first axis generally parallel to the first panel and perpendicular to the central axis, a second axis generally parallel to the second panel and perpendicular to each of the central axis and first axis, where the first panel is adapted for rotation transverse to the first axis, the second panel is adapted for rotation transverse to the second axis, and the united first and second panels adapted for rotation transverse to the central axis, wherein the first and second panel generally rotate independently towards and away from the central axis. In another embodiment, the apparatus may further include a top panel having a lower and an upper surface, the lower surface generally overlying the first, second and third panels, the upper surface presenting a rigid surface for receiving successive layers of first, second and third panels.

BRIEF DESCRIPTION OF THE DRAWINGS

The drawings constitute a part of this invention and include exemplary embodiments of the present invention and illustrate various objects and features thereof.

DETAILED DESCRIPTION

I. Introduction.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Walled Structure.

Figure 1:
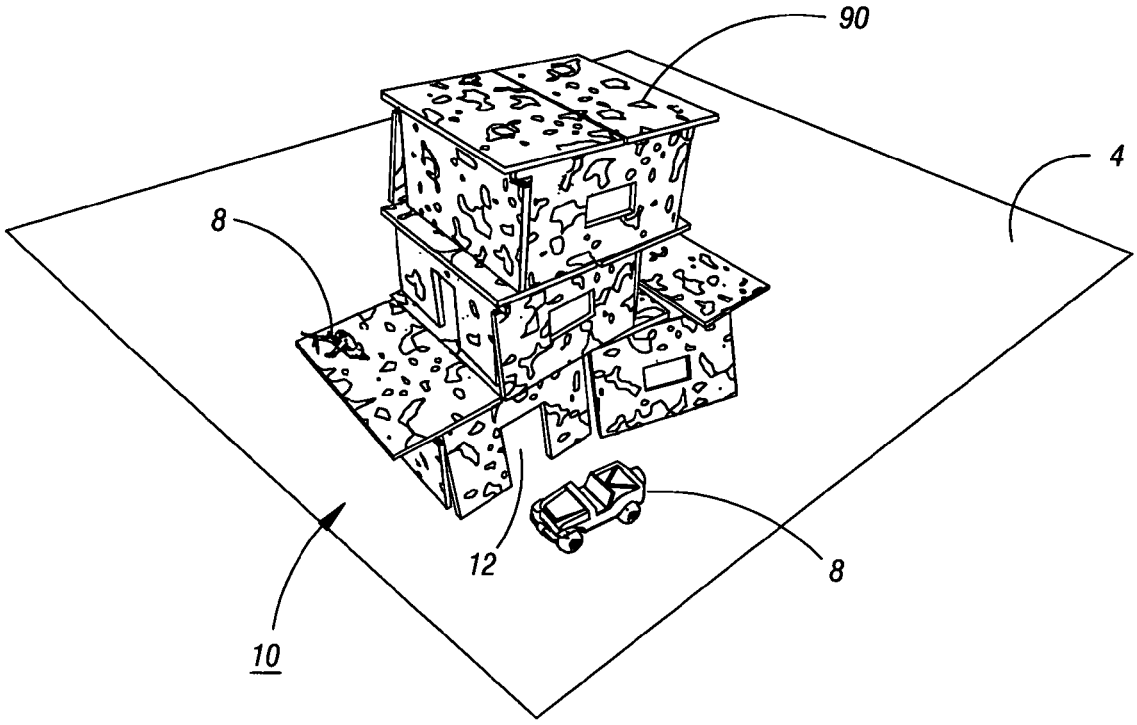
FIG. 1 is a perspective view of the walled structure apparatus in accordance with the present invention in a deformed condition.

Referring to FIG. 1, an embodiment of the present invention a walled structure apparatus generally indicated by reference numeral 10 being generally located on a horizontal surface 4, the walled structure apparatus 10 being generally adapted to illustrate a deformed structure 6. The deformed structure 6 is illustrated with a plurality of panels vertically and horizontally arranged, the plurality of panels associated together and adapted for receiving other panels vertically stacked. Additionally and optionally, the panels may be associated with toy accessories 8 such as but not limited to figurines and models. The panels illustrated in FIG. 1 also illustrate the panels which may be optionally adapted to receive a visual indicia 90.

Figure 2:
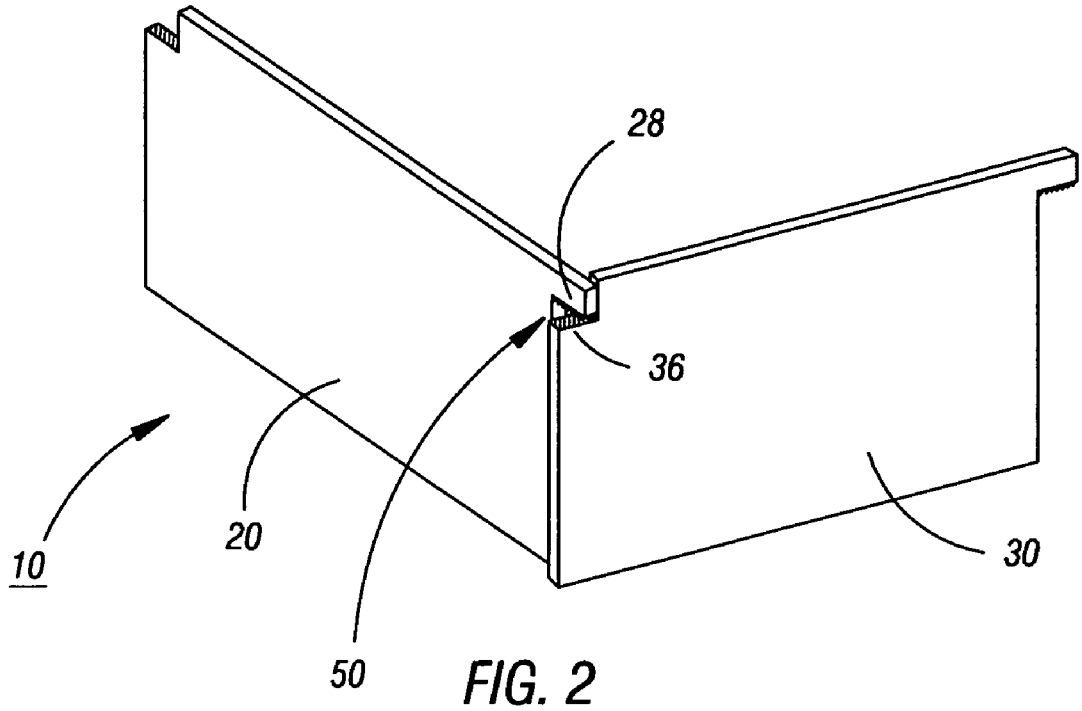
FIG. 2 is a front perspective view of the apparatus in accordance with the present invention.

FIG. 2 illustrates the normal configuration of the first and second panels 20, 30. In this configuration, the projecting tab 28 of the first panel 20 is received by the notch 36 presented by the second panel 30. The first panel 20 is secured to the second panel 30 at the intersection of the joint between the projecting tab 28 and the notch 36 generally by, but not limited to, the hinge structure 50. Although other mechanically securing mechanisms may be utilized by the projecting tab 28 and notch 36, in the illustrated embodiment it is generally accomplished by the hinge structure 50 which provides for resistive rotation of the first panel 20 and second panel 30.

Figure 3:
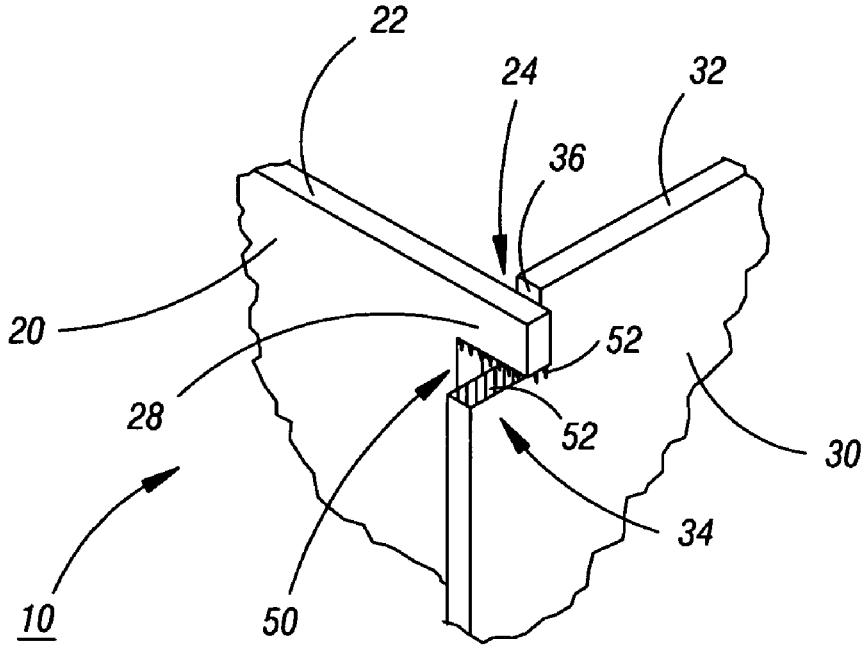
FIG. 3 is a front sectional perspective view of the apparatus according to the present invention.

FIG. 3 illustrates the first panel 20 associated with a second panel 30, the first panel having a major plane 22 extending along panel 20 to a corner 24 presenting a projecting tab 28. The second panel 30 has a major plane 32 which extends along the second panel 30 to a corner 34 and a notch 36 therein. The projecting tab 28 is received within the notch 36. A hinge structure 50 is illustrated in the notch, generally uniting the first and second panels 20, 30. The hinge structure 50 is illustrated with interengaged flexible components 52 located in the illustrated notch and tab 28, 36. The hinge 50 in operation provides for rotation of the panels of the walled structure from a normal position to a deformed position where the panels 20, 30 each are adapted for independent vertical rotation inwardly and outwardly to a selected position about a horizontal axis. The united panels 20, 30 may also rotate horizontally together about a vertical axis. In this way, the moveable panels 20, 30 allow the walled structure apparatus 10 to illustrate the deformed structure shown in FIG. 1.

Figure 4:
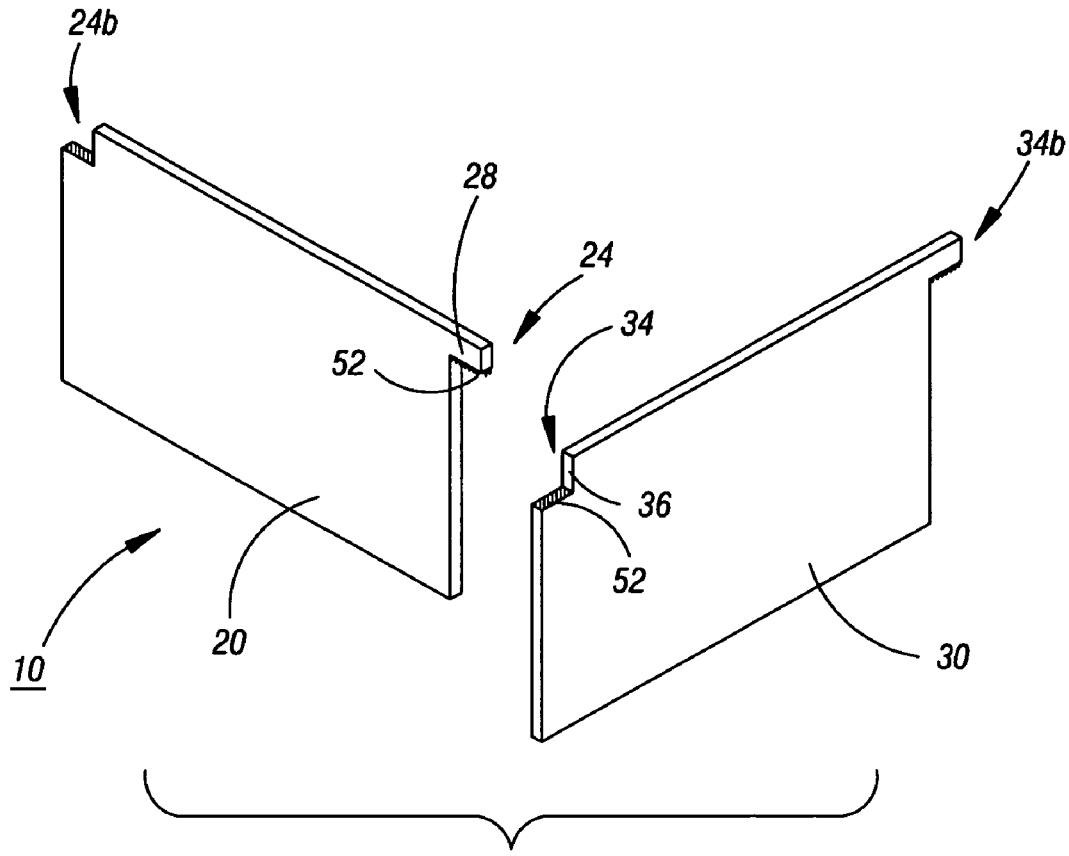
FIG. 4 is an exploded front perspective view of the apparatus in accordance with the present invention.

The first and second panels 20, 30 are separated from each other in FIG. 4, with the major plane 22 extending between a second corner 24*b* and a first corner 24 terminating at the projecting tab 28, while the major plane 32 extends between a second corner 34*b* and a first corner 34 terminating at the notch 36. As is further illustrated in FIG. 4, the flexible components 52 of the hinge 50 are adapted to engage one another while allowing for rotational movement of the panels 20, 30.

Figure 5:
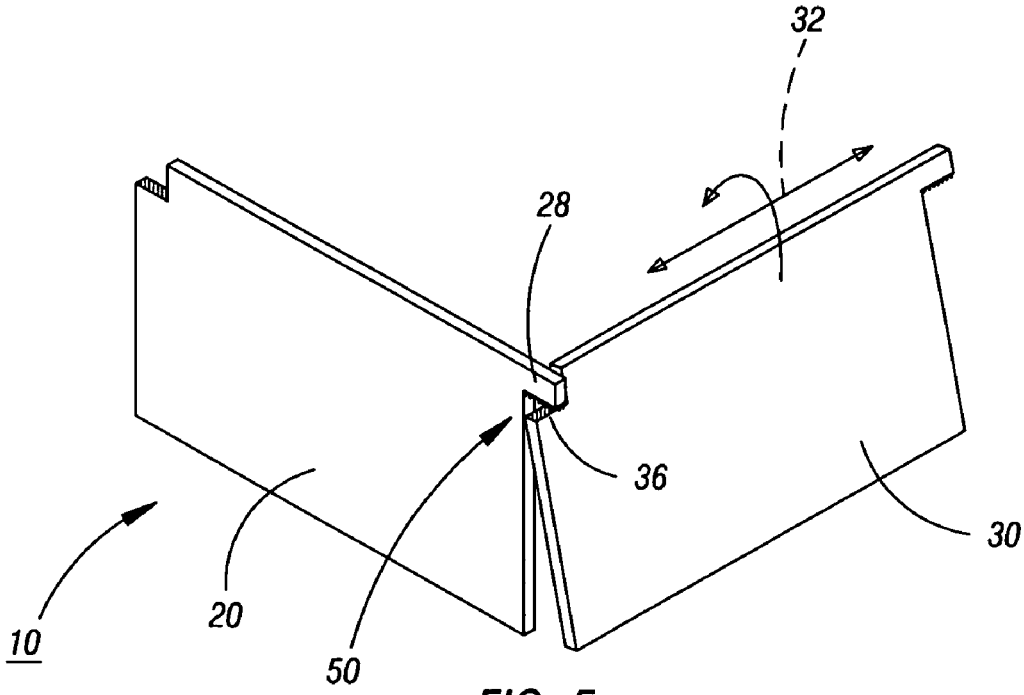
FIG. 5 is a front perspective view of the apparatus in accordance with the present invention.

The second panel 30 is illustrated in FIG. 5 vertically rotated about the horizontal axis of the major plane 32. While the second panel 30 is outwardly rotated from the first panel 20, the flexible hinge components 52 of the hinge 50, located at the notch 36, remain engaged. In this manner, the second panel 30 can rotate outwardly or inwardly relative to the first panel 20 while both panels 20, 30 remain engaged at the hinge structure 50.

Figure 6:
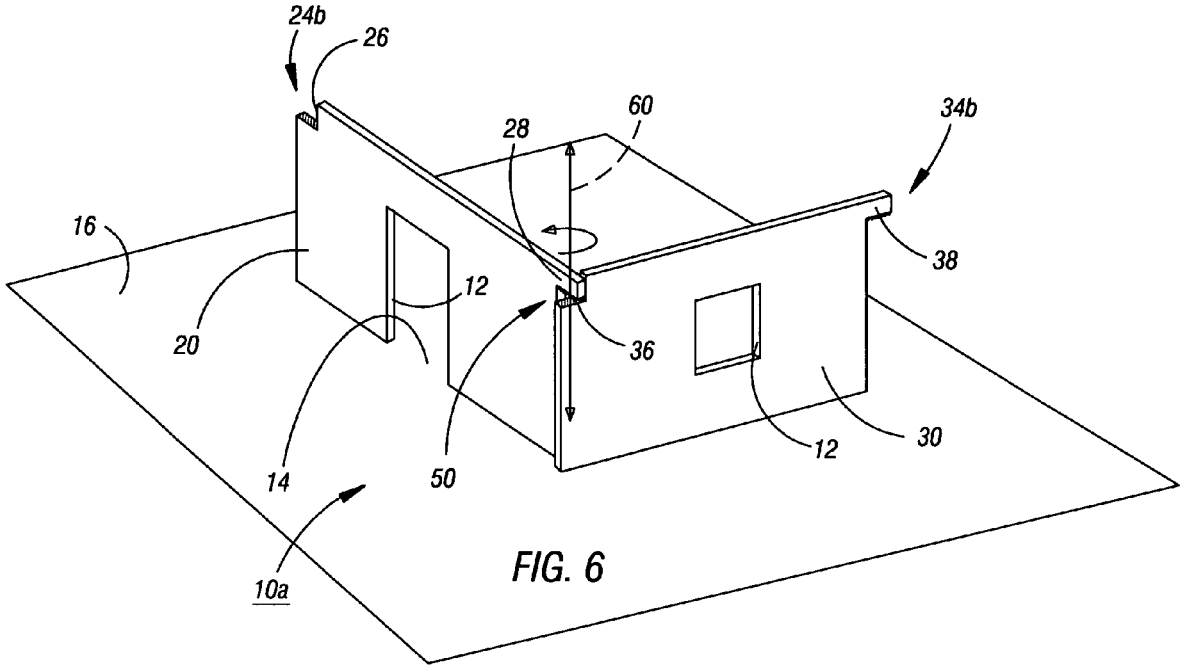
FIG. 6 is a top perspective view of the apparatus in accordance with an alternative embodiment of the present invention.

An alternative embodiment of the walled structure apparatus is illustrated in FIG. 6 having a panel opening 12 located for example, at the first and second panel 20, 30. Alternatively, the panel openings 12 may be associated with either the first 20 or second 30 panels. In generally, the panel openings provide for communication between an internal area 14 and a complementary outer area 16. The panel openings may have a variety of geometric configurations including circular, rectangular or triangular, however, in general they may simulate an occupied structure for transmission of various objects through the panel openings 12. In addition, FIG. 6 illustrates a central axis 60 extending though the horizontal surface 4 and parallel to the panels 20, 30. The central axis 60 depicted in FIG. 6 is a vertically orientated axis about which the first and second panels 20, 30 may horizontally rotate.

Figure 7:
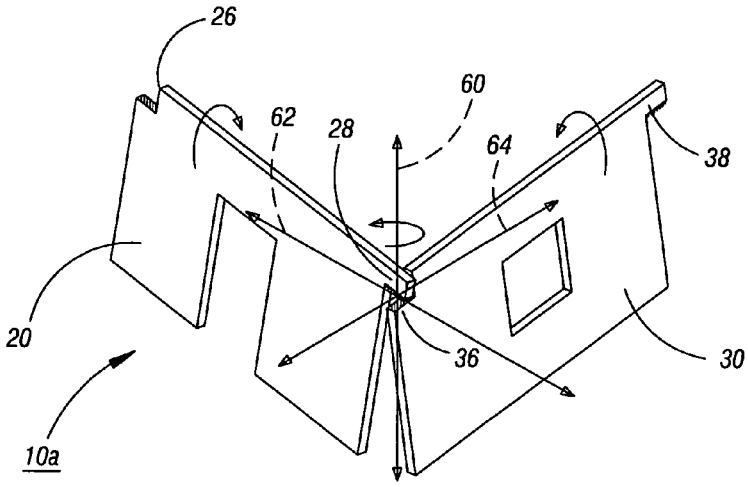
FIG. 7 is a top perspective view of the apparatus in accordance with an alternative embodiment of the present invention.

As shown in FIG. 7, the panels 20, 30 may rotate horizontally generally together about the central axis 60 or vertically generally independently about a first axis 62 associated with the major plane 22 or a second axis 64 associated with the major plane 32 for exhibiting a deformed structure. The first axis 62 is generally parallel to the first panel 20 and perpendicular to the central axis 60. The second axis 64 is generally parallel to the second panel 30 and perpendicular to the central axis 60 and the first axis 62. In general, the first panel 20 is adapted to rotate transverse to the first axis 62, while the second panel 30 is adapted to rotate transverse to the second axis 64. While connected by the interengaged flexible components, the first and second panels 20, 30 are adapted for rotation transverse to the central axis 60, where the first and second panels 20, 30 generally rotate independently towards and away from the central axis 60. In this way, the hinge structure 50 depicted in FIG. 7, may allow for multi-dimensional rotation between the projecting tab 28 of the first panel 20 received by the notch 36 presented by the second panel 30. As illustrated in FIG. 7 the second corner 24*b* of the first panel 20 may optionally present a notch 26 and the second corner 34*b* of the second panel 30 may optionally have a projecting tab 38.

Figure 8:
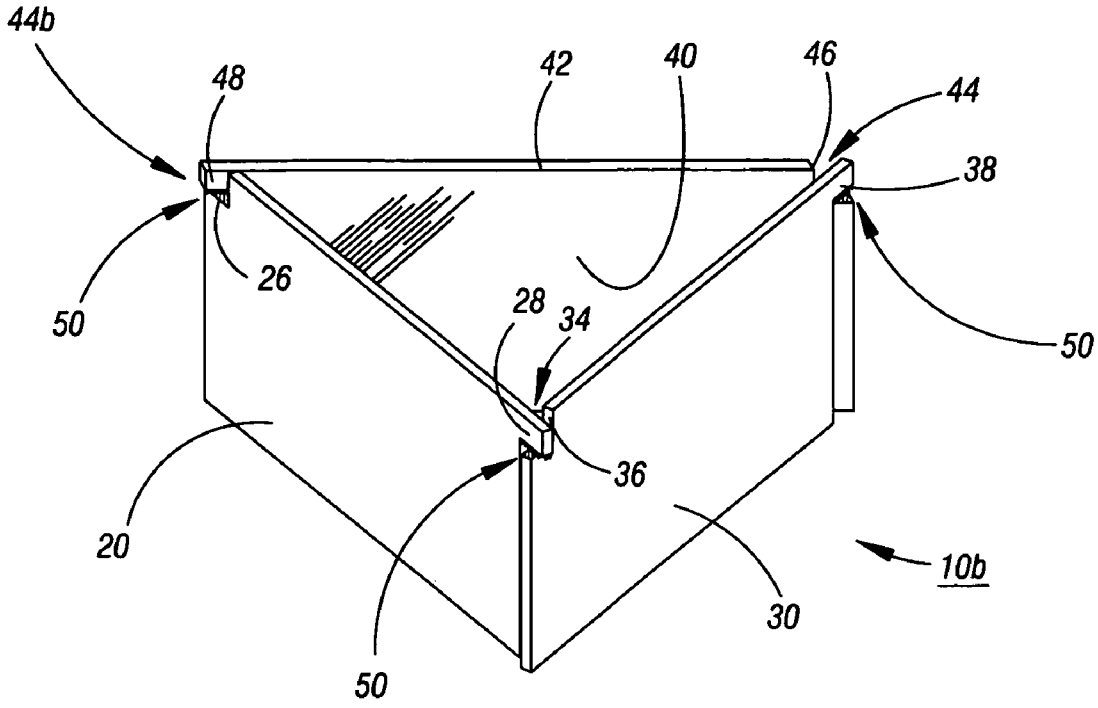
FIG. 8 is a top perspective view of the apparatus in accordance with an alternative embodiment of the present invention.

An alternative embodiment of the present invention illustrated in FIG. 8 may include the addition of a third panel 40 having a first corner 44 separated from a second corner 44*b* along a major plane 42, the third panel 40, first corner 44 presenting a notch 46 adapted for receiving the projecting tab 38 of said second panel 30 second corner 34*b* and the third panel 40 second corner 44*b* having a projecting tab 48 received within the notch 26 of the first panel 20 second corner 24*b*. Hinge structure 50 within each of the notches 26, 36, 46 unites the panels 20, 30, 40 for vertical movement of each panel 20, 30, 40 in relation to each other to any one of a number of selected positions inwardly and outwardly. The hinge structure 50 illustrated in FIG. 8 includes interengaged flexible components 52 located at each of the notches 26, 36, 46 and projecting tabs 28, 38, 48. In addition to the vertical movement inwardly and outwardly, the interengaged flexible components 52 permit horizontal movement towards and away from the central axis 60 to any one of a number of selected positions, for exhibiting the deformed structure 6.

Figure 9:
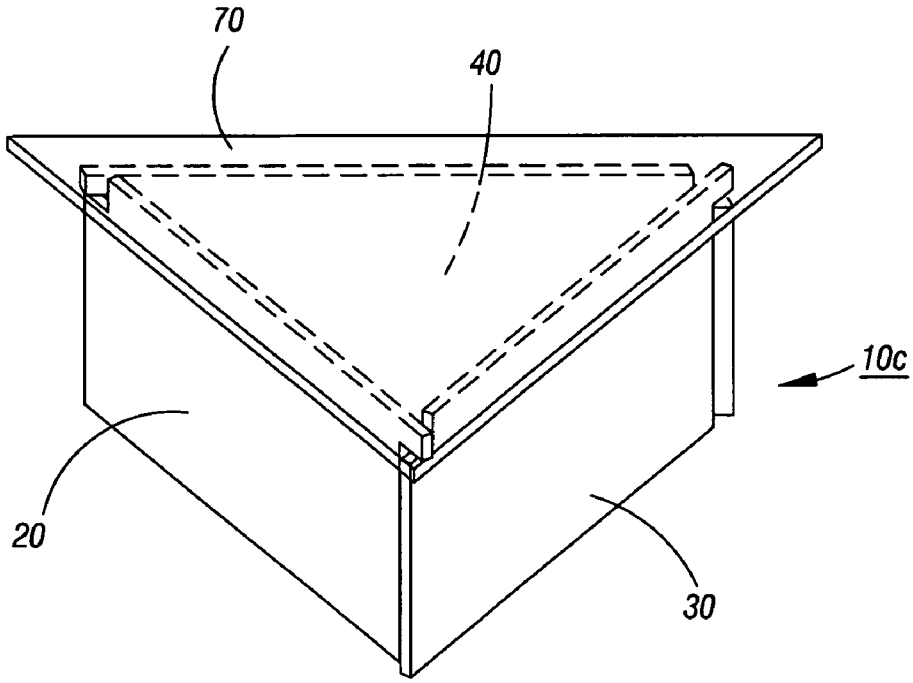
FIG. 9 is a top perspective view of the apparatus in accordance with an alternative embodiment of the present invention.
Figure 10:
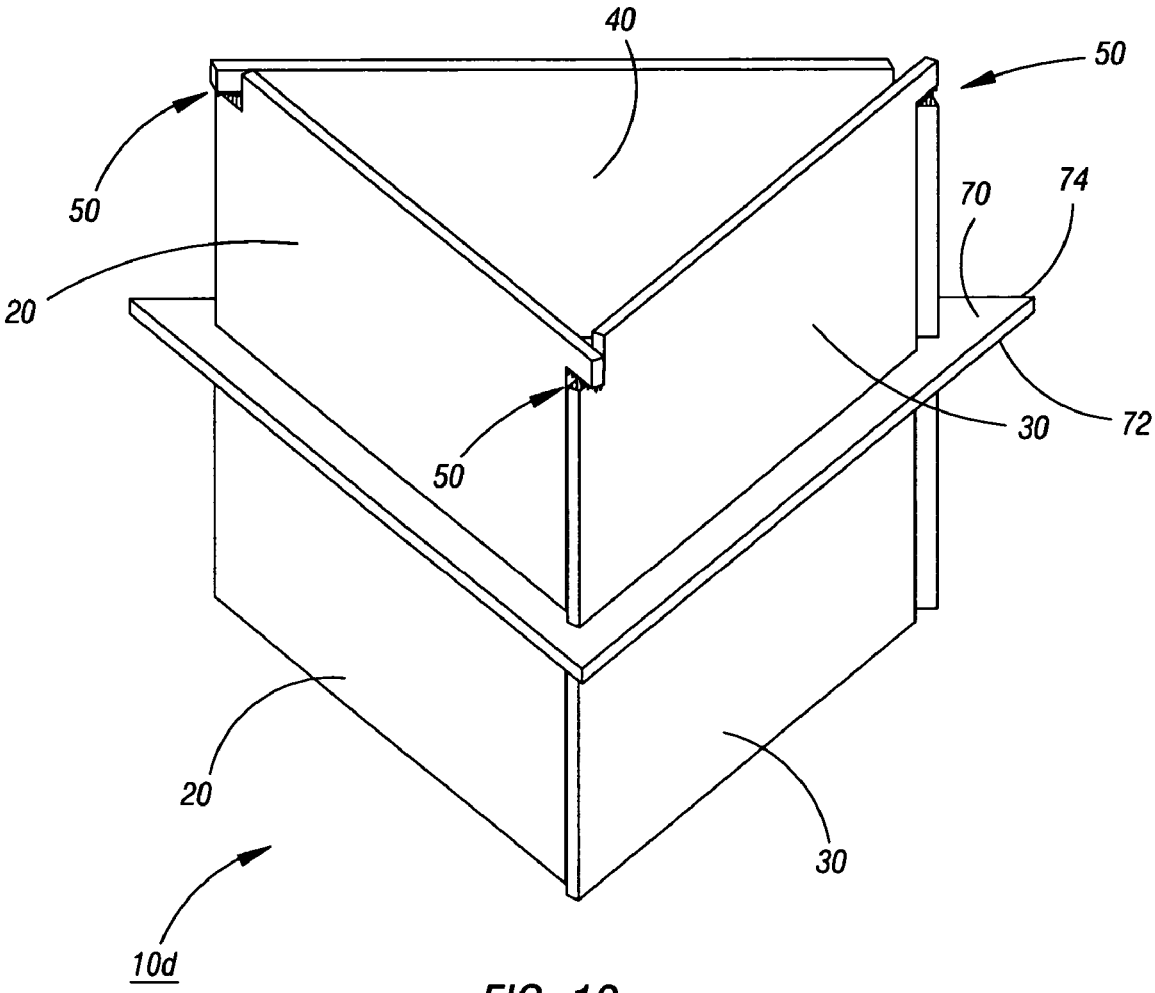
FIG. 10 is a top perspective view of the apparatus in accordance with an alternative embodiment of the present invention.

FIG. 9 illustrates another alternative embodiment of the present invention in a generally normal orientation which includes a top panel 70 having a lower and upper surfaces 72, 74, the lower surface 72 generally overlying the first, second and third panels 20, 30, 40. The upper surface 74 of the top panel 70 may present a rigid surface for receiving and supporting successive layers of first, second and third panels 20, 30, 40 as illustrated in FIG. 10.

Figure 11:
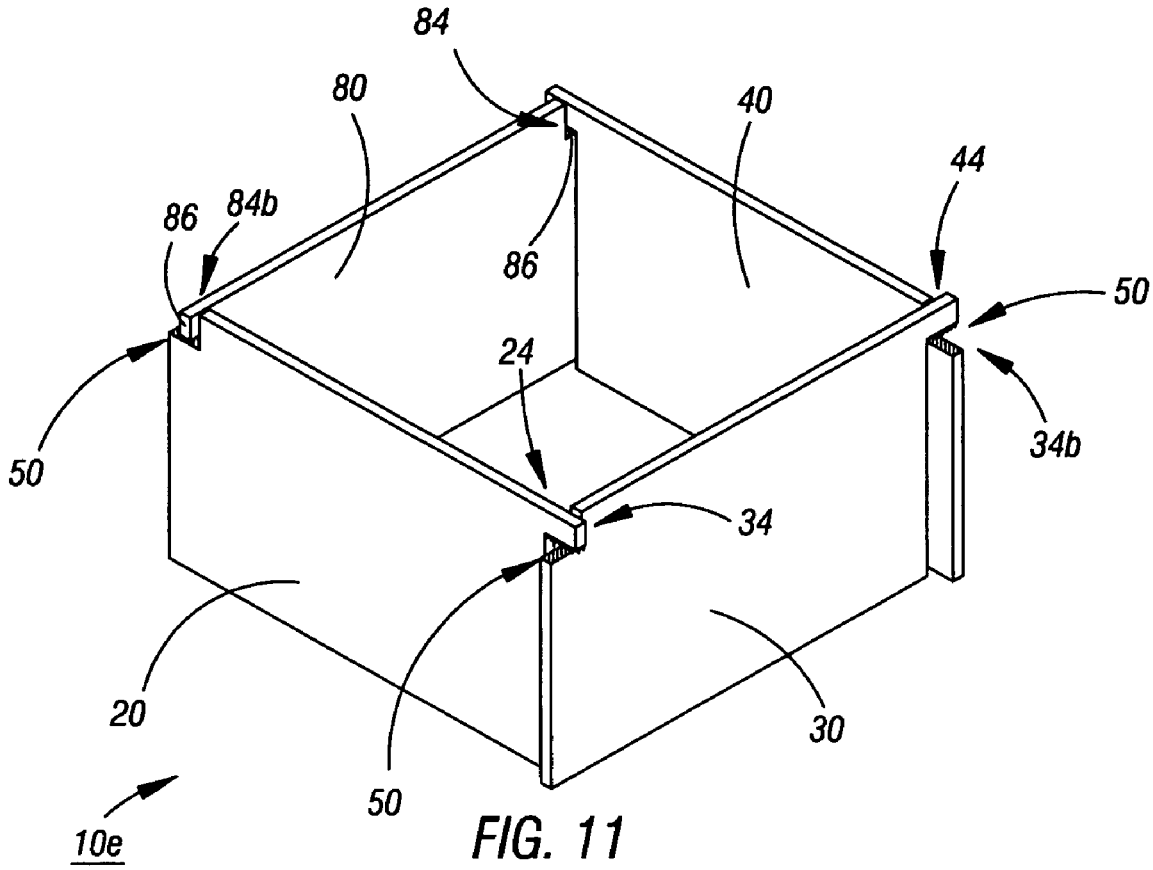
FIG. 11 is a top perspective view of the apparatus in accordance with an alternative embodiment of the present invention.
Figure 12:
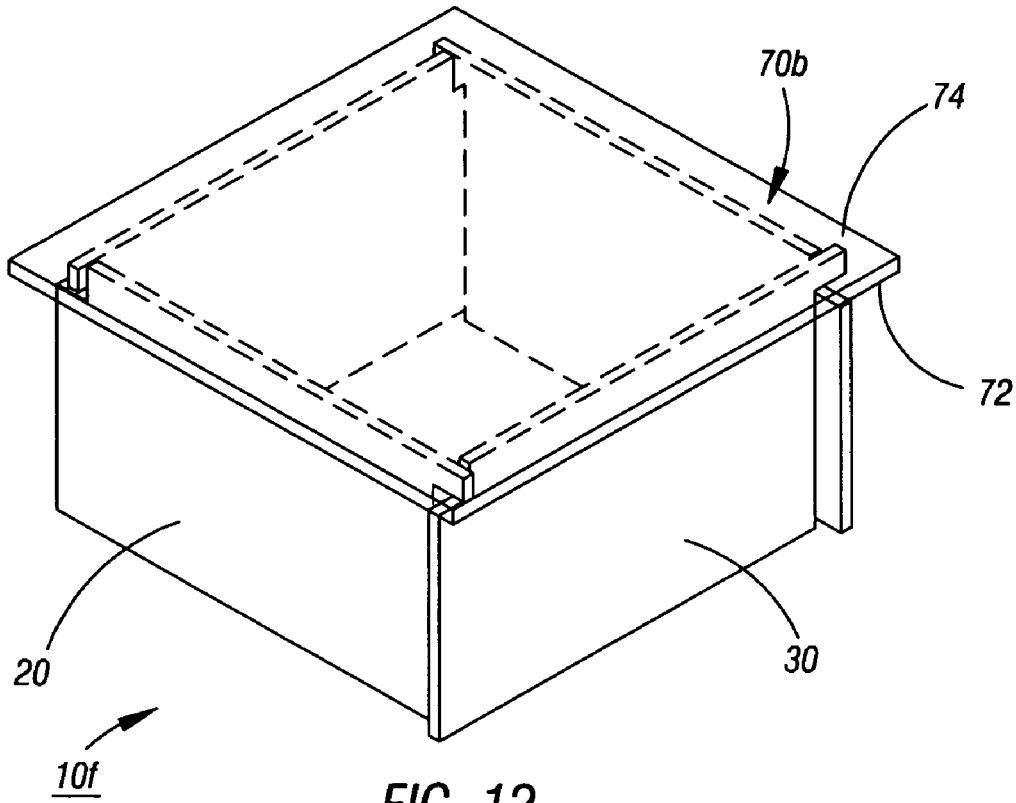
FIG. 12 is a top perspective view of the apparatus in accordance with an alternative embodiment of the present invention.

Another alternative embodiment of the present invention is illustrated in FIG. 11 with a fourth panel 80 having a first corner 84 separated from a second corner 84*b* along a major plane 82. The fourth panel 80, first corner 84 presenting a notch 86 adapted for receiving the projecting tab 48 of said third panel 40 second corner 44*b* and the fourth panel 80 second corner 84*b* having a projecting tab 88 received within the notch 26 of the first panel 20 second corner 24*b*. In the illustrated embodiment, the first panel 20 is generally parallel to the third panel 40 and the fourth panel 80 is generally parallel to the second panel 30 such that the illustrated alternative walled structure is generally rectangular. Another alternative embodiment is illustrated in FIG. 12 with a generally rectangular top panel 70*b* having an upper surface 74*b* and a lower surface 72*b*, the top panel 70*b* overlying the first, second, third and fourth panels 20, 30, 40, 80.

Figure 13:
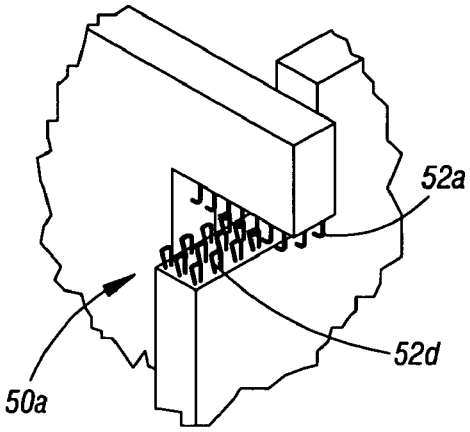
FIG. 13 is a sectional perspective view of the apparatus accordance with an alternative embodiment of the present invention.
Figure 14:
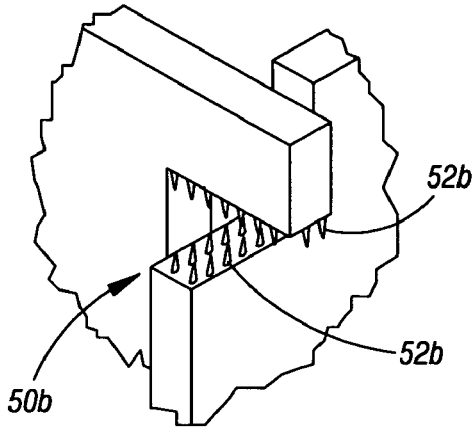
FIG. 14 is a sectional perspective view of the apparatus accordance with an alternative embodiment of the present invention.
Figure 15:
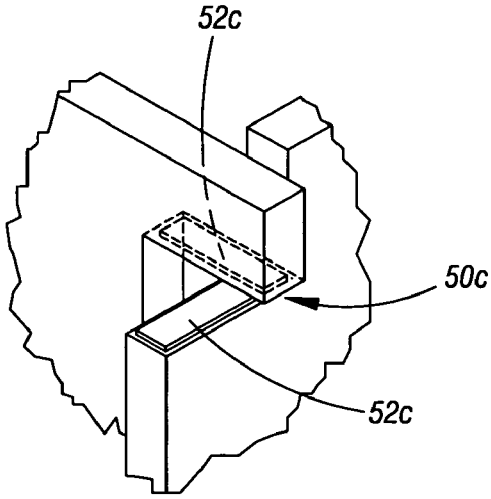
FIG. 15 is a sectional perspective view of the apparatus accordance with an alternative embodiment of the present invention.

FIGS. 13-15 illustrate alternative embodiments of the hinge structure with a mechanical connection located at the notch below the overlying panel projecting tab. As an example, but not as a limitation, the interengaged flexible components 52*a* and 52*d* are illustrated in FIG. 13 as a hook and loop mechanical connection. In general, the mechanical connections provide a flexible replaceable connection which allows the panels to be rotated a plurality of degrees without the connection failing, while allowing the panels to be removed from each other as desired. In this fashion, the panels may be separated for storage or for reconfiguration of the walled structure 6 based upon the user's needs. Alternative hinge structure 50*b* may include mechanical connections which may include descending and ascending engaging appendages 52*b* illustrated in FIG. 14, or alternative hinge structure 50*c* having complementary magnetic strips 52*c* illustrated in FIG. 15.

It will be appreciated that various other configurations and embodiments may fall within the scope of the present invention. While certain forms of the present invention have been illustrated and described herein, it is not to be limited to the specific forms or arrangement of parts described and shown.

Having thus described the invention, what is claimed as new and desired to be secured by Letters Patent is as follows:

1. A walled structure apparatus orientated perpendicular to a horizontal surface comprising:

a plurality of panels each said panel having a major plane with a first corner and a notch therein and a second corner having a projecting tab adapted for receipt within said notch, whereby said tab of a first panel rests within said notch of a second panel, each said first corner presented at the intersection of a top edge and one of a pair of straight edges extending vertically downward from said notch to the bottom of the panel, said top edge extending horizontally from said notch to said tab, said second straight edge extending vertically downward from said tab to the bottom of the panel, a hinge structure in said notch uniting said panels for relative movement of each panel to any one of a number of selected positions and said structure including interengaged flexible components in said notch and said tab permitting said relative movement inwardly and outwardly to said selected position to exhibit a deformed structure.

2. The apparatus according to claim 1 further comprising a central axis parallel to said panels and extending through the horizontal surface wherein said first and second panels rotate about said central axis for exhibiting the deformed structure.

3. The apparatus according to claim 2 further comprising:

a panel opening, an internal area located between said panels and said central axis, and a complementary outer area located between said panels and opposite said internal area, wherein said internal area is in communication with said outer area at said panel openings.

4. The apparatus according to claim 2 further comprising:

a first axis generally parallel to said first panel and perpendicular to said central axis, a second axis generally parallel to said second panel and perpendicular to each of said central axis and first axis, said first panel adapted for rotation transverse to said first axis, said second panel adapted for rotation transverse to said second axis, and said first and second panels adapted for rotation transverse to said central axis, wherein said first and second panels generally rotate independently towards and away from said central axis.

5. The apparatus according to claim 2 further comprising:

said first panel having a second corner presenting a notch therein, said second panel presenting a second corner having a projecting tab, a third panel having a first and a second corner, said third panel, first corner presenting a notch adapted for receiving the projecting tab of said second panel and said third panel second corner presenting a projecting tab received within said notch of said first panel, said hinge structure in each of said notches of said panels uniting each of said panels for relative movement of each panel to any one of a number of selected positions, and said interengaged flexible components in each of said notches and each of said tabs permitting rotation transverse to said central axis, wherein said first, second and third panels generally rotate independently towards and away from said central axis to said selected position, exhibiting the deformed structure.

6. The apparatus according to claim 5 further comprising a top panel having a lower and an upper surface, said lower surface generally overlying said first, second and third panels.

7. The apparatus according to claim 6 wherein said top panel presents a rigid surface for receiving successive adjacent layers of first, second and third panels overlying said top panel.

8. The apparatus according to claim 5 further comprising:

a fourth-panel having a first and a second corner, said fourth-panel, first corner presenting a notch for receiving said projecting tab of said third-panel, said fourth-panel, second corner having a projecting tab for receipt within said notch of said first-panel, wherein said first-panel is generally parallel to said third-panel and said fourth panel is generally parallel to said second-panel.

9. The apparatus according to claim 8 further comprising a top panel having a lower and an upper surface, said lower surface generally overlying said first, second, third and fourth panels.

10. The apparatus according to claim 9 wherein the top panel presents a rigid surface for receiving successive adjacent layers of first, second, third and fourth panels overlying said top panel.

11. The apparatus according to claim 1 wherein said flexible components further includes a hook and loop style connectors at said notch for uniting said panels.

12. The apparatus according to claim 1 wherein said flexible components further include ascending and descending engaging appendages at said notch and said tab for uniting said panels.

13. The apparatus according to claim 1 wherein said flexible components further includes a magnetized end wherein said panels are attracted at said notch for uniting said panels.

14. The apparatus according to claim 1 wherein said panels are adapted for receiving visual indicia.

* * * * *